United States Patent [19]

Reinhold

[11] Patent Number: 4,711,291

[45] Date of Patent: Dec. 8, 1987

[54] A METHOD FOR MAKING A ROLL FOR PROCESSING A WEB OR STRIP OF MATERIAL

[76] Inventor: Klaus Reinhold, Lienener Strasse 59, 4540 Lengerich, Fed. Rep. of Germany

[21] Appl. No.: 901,487

[22] Filed: Aug. 28, 1986

Related U.S. Application Data

[62] Division of Ser. No. 711,866, Mar. 14, 1985, Pat. No. 4,683,627.

[30] Foreign Application Priority Data

Mar. 24, 1984 [DE] Fed. Rep. of Germany ..... 8409106

[51] Int. Cl.[4] ..... B21B 31/08; B22D 19/00

[52] U.S. Cl. ..... 164/98; 165/89; 29/123; 29/127; 29/128; 29/132

[58] Field of Search ..... 29/110, 123, 127, 128, 29/132; 164/98, 91, 108, 289, 332, 421, 422, 176, 461, 464; 165/89

[56] References Cited

U.S. PATENT DOCUMENTS 3,216,489 11/1965 Norton ..... 165/14

4,113,002 9/1978 Fukuta et al. ..... 164/286

FOREIGN PATENT DOCUMENTS 188596 11/1922 United Kingdom ..... 164/108

326272 1/1972 U.S.S.R. ..... 165/89

*Primary Examiner*—Timothy V. Eley

*Attorney, Agent, or Firm*—Jordan and Hamburg

[57] ABSTRACT

A roll for processing material in the form of a web or strip consists of a cylindrical hollow body of metal, in the cylinder wall of which there is provided a helical medium passage through which a heating or cooling medium can flow. In order to avoid sealing problems in the region of the cylinder wall and to achieve a high heating or cooling performance, the cylinder wall is formed from a cast metal tube and the helical medium passage is formed from a spiral tube of a metal having a distinctly higher melting temperature in comparison with that of the cylinder wall, the spiral tube being rigidly embedded in the cylinder wall during casting thereof. The cylinder wall consists particularly advantageously of a centrifugally cast tube, preferably of aluminium, in the wall of which the spiral tube is included in the casting.

4 Claims, 2 Drawing Figures

A METHOD FOR MAKING A ROLL FOR PROCESSING A WEB OR STRIP OF MATERIAL

Figure 1:
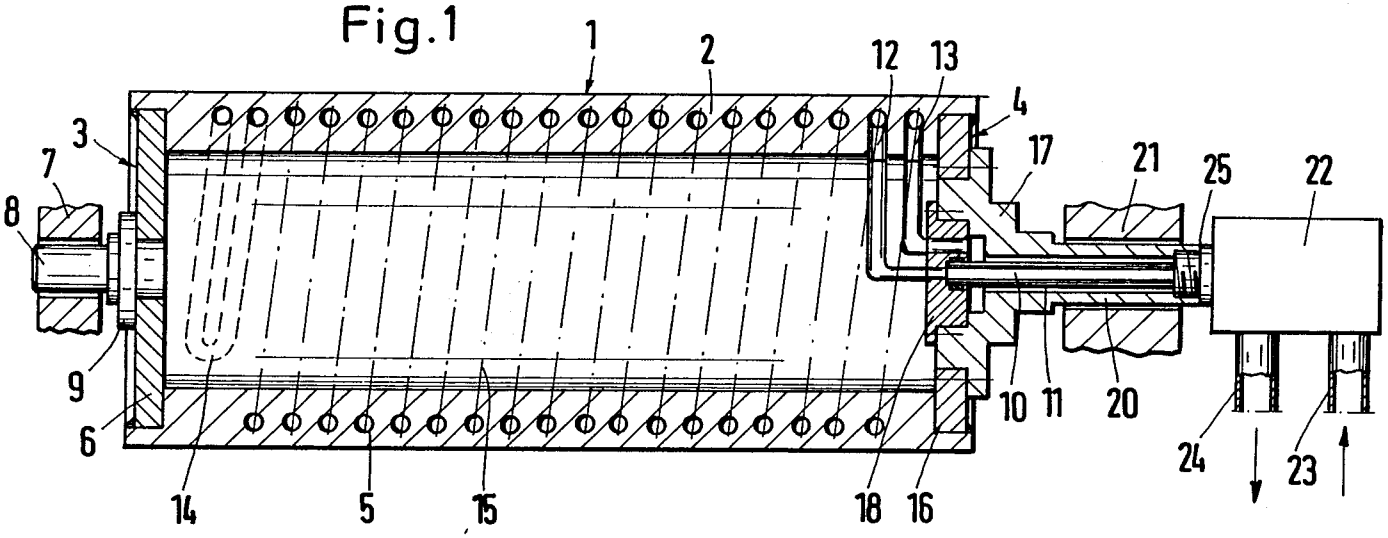

This is a division of application Ser. No. 711,866, filed Mar. 14, 1985 now U.S. Pat. No. 4,683,627.

The invention relates to a roll for processing material in the form of a web or strip, consisting of a cylindrical hollow body of metal in the cylinder wall of which there is provided a helical passage through which a heating or cooling medium can flow and the ends of which are closed by end closures which include a passage for a conduit for the flowing medium.

Such rolls are used as heating or cooling rolls for the processing of material in the form of a web or strip, such as textiles, paper, cardboard, plastics sheets or metal foils, in order to heat or cool these materials, in the course of their production or processing or further treatment, by their contact engagement with the cylinder wall of the roll. In the course of this, the flat material in the form of a web or strip is generally conveyed over the roll while being partially wrapped round the cylinder jacket, the roll being mounted for rotation and possibly driven in a suitable manner.

In a known roll of the type indicated, the cylindrical, metal, hollow body forming the roll consists of a roll core with a central bore, the passage through which the heating or cooling medium can flow being formed by helical channels which are cut in the surface of the roll core. In this manner, a helical passage for the medium is formed in conjunction with a roll jacket which is placed on the roll core after the channels have been cut.

The production of these known heating or cooling rolls involves very heavy expenditure on labour which is caused, in particular, by the fact that, in connection with the production of the passages, very careful machining of the surface of the roll core and of the cooperating surface of the jacket sleeve is necessary. In addition, in the case of rolls constructed in two parts in this manner there is always the problem of leaks between the roll core and the roll jacket and of leakage losses of the flowing medium.

It is the object of the invention to provide a roll for the processing of flat material in the form of a web or strip, which is simple to produce, avoids sealing problems in the region of the cylinder wall and has a highly effective heating or cooling performance.

The present invention provides a roll for processing material in the form of a web or strip, consisting of a cylindrical hollow body of metal, in the cylinder wall of which there is provided a helical medium passage through which a heating or cooling medium flows and the ends of which are closed by end closures including a passage for a conduit for the flowing medium, and in which the cylinder wall is formed from a cast metal tube and the helical medium passage is formed from a spiral tube of a metal having a distinctly higher melting temperature than that of the cylinder wall, the spiral tube being rigidly embedded in the metal of the cylinder wall.

With this construction, the heavy manufacturing expense of the prior two part heating roll is avoided in a simple manner in that the cylinder wall is formed from a cast metal tube in which the spiral tube defining the helical passage is firmly embedded, as a simple prefabricated component, the tube metal being cast around it and then solidifying.

This firm engagement is ensured as the metal of the prefabricated spiral tube has a distinctly higher melting temperature than the casting metal forming the cylinder wall which, in the molten state, surrounds the solid spiral tube on all sides during the casting operation and shrinks onto the spiral tube during its cooling and setting. As a result of the intimate connection of the spiral tube to the metal of the cylinder wall, achieved in this manner, not only are all sealing problems in the region of the cylinder wall avoided, but also a rapid temperature control and a highly effective heating or cooling performance are achieved by rapid, satisfactory heat conduction through the cylinder wall.

An embodiment in which the cylinder wall is formed from a centrifugally cast tube, in the wall of which the spiral tube is included in the casting, has proved particularly advantageous. The particularly fine, dense structure of the cylinder wall with very satisfactory strength characteristics, achieved by the centrifugal casting, further encourages the transmission of heat through the cylinder wall and the anchoring engagement of the spiral tube, and moreover the spiral tube can be inserted and located, in a simple manner, as a prefabricated component, in the rotary mould used during the centrifugal casting.

Fundamentally, any suitable metals or alloys can be used as casting metal for the cylinder wall and as metal for the prefabricated spiral tube, provided the melting temperature of the spiral tube is distinctly higher than that of the casting metal because a change in shape of the spiral tube as a result of softening or melting of its metal must be avoided during the casting operation. From the practical point of view, an embodiment wherein the spiral tube consists of steel or a steel alloy and the cylinder wall consists of aluminium of an aluminium alloy has proved particularly advantageous. The melting points of steel and aluminium are so far apart that a deformation of the prefabricated spiral steel tube by softening during the casting of the cylinder wall is out of the question. In addition, a spiral tube made of steel has such a high strength that the shrinkage forces occurring during the setting of the cast aluminium can be taken up without risk by the spiral tube. It is advisable to effect the cooling of the casting at ambient temperature in order to ensure a slow and therefore uniform shrinking of the casting metal onto the spiral steel tube, in the interests of intimate anchoring.

In a further feature of embodiments of the invention, of the two end closures, one forms a bearing plate shutting off the associated end of the hollow body as a whole, while the other is constructed in the form of a bearing and connection plate with the passage for the conduit for the flowing medium which comprises two coaxial flow passages each of which is connected, via a flexible connecting pipe, to the inflow end and return flow end respectively of the spiral tube in a region immediately adjacent to the bearing and connection plate.

Figure 2:
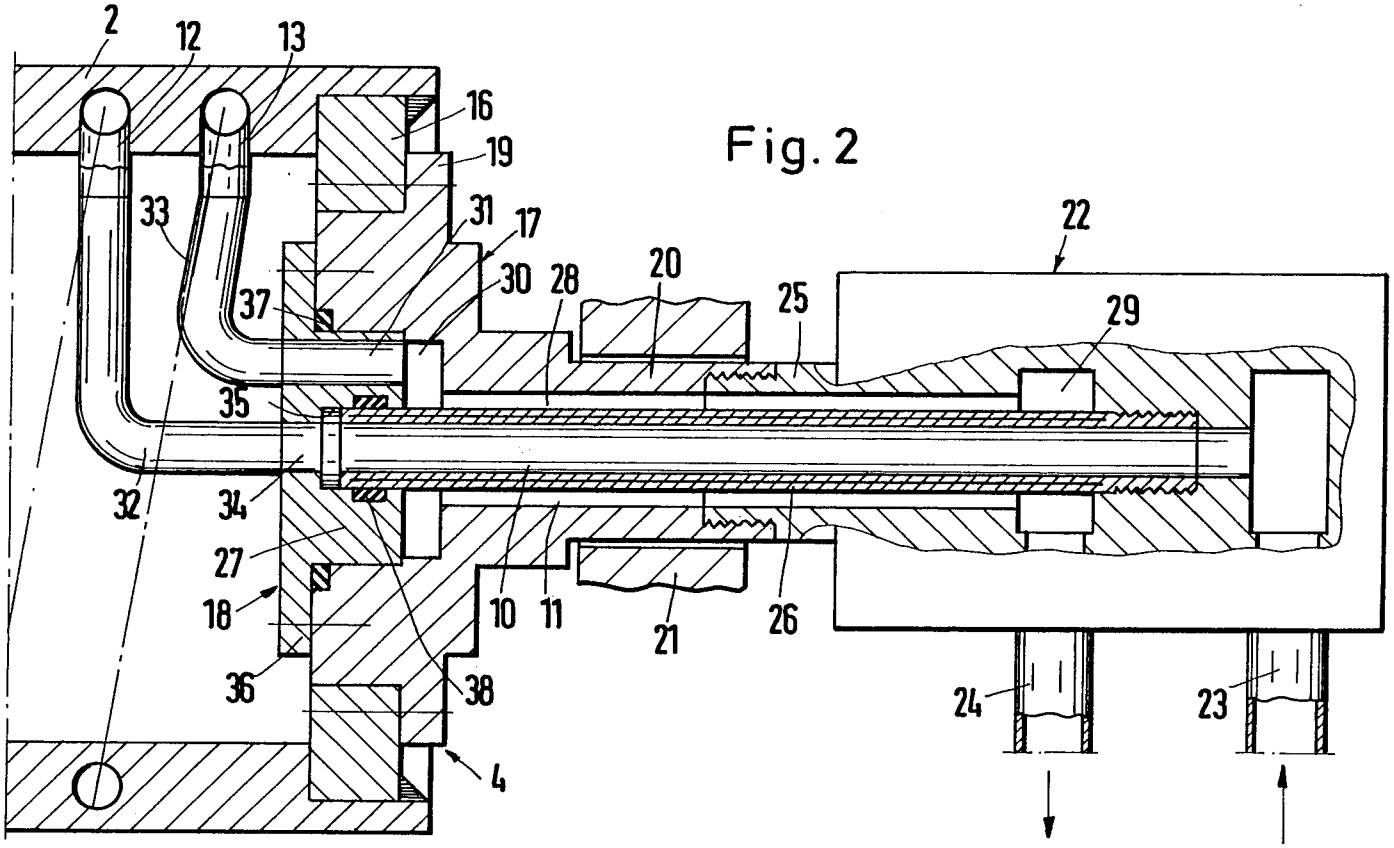

Embodiments of the present invention will now be described, by way of example, with reference to the accompanying drawings, in which:

FIG. 1 is a longitudinal section through a heating or cooling roll according to the invention for processing material in the form of a web or strip; and FIG. 2 shows an end region of the roll of FIG. 1 to a larger scale.

The heating or cooling roll illustrated in the drawing, for the processing of material in the form of a web or strip, such as webs of paper or of plastics sheet, consists of a cylindrical hollow body 1 of metal, aluminium in the embodiment illustrated, having a cylinder wall 2 and two end closures 3, 4 each of which closes one of the two ends of the cylinder wall. The cylinder wall 2 is formed from a centrifugally cast tube in the wall of which a spiral tube 5 of a metal having a higher melting point than the metal of the cylinder wall 2, such as steel, is included in the casting and so rigidly connected to the cylinder wall. The melting temperature of aluminum is approximately 660° C. and the melting temperature of steel is approximately 1500° C.

The spiral tube 5 forms a helical passage through which a heating or cooling medium flows when the roll is in operation. Any fluid suitable for these purposes, in liquid, vapour or gaseous form, may be considered as a heating or cooling medium. Since the spiral tube 5 included in the casting of the cylinder wall 2 does not cause any sealing problems, it is also possible, in particular, to connect the roll to a low-temperature cooling plant working with a cooling gas, for example on a methane base. As usual with centrifugally cast tubes, the thickness of the cylinder wall 2 only amounts to a fraction of the tube diameter, for example 1/6th which facilitates a rapid temperature control as a result of the small participating masses.

The end closure 3 comprises a bearing plate 6 which shuts off the associated end of the hollow body 1 as a whole and which is welded to the cylinder wall 2. The end closure 3 further comprises a bearing pin 8, which is bolted to the bearing plate 6 by means of a flange 9, for rotatably mounting of the roll in a bearing indicated diagrammatically at 7.

The other end closure 4 is constructed in the form of a bearing and connection plate with a passage for the conduit for the flowing medium which comprises two coaxial flow passages 10 and 11. One of the two flow passages 10, 11, the flow passage 10 in the example selected, is in flow communication with the inflow end 12 and accordingly the other flow passage 11 is in flow communication with the return-flow end 13 of the spiral tube 5. The inflow end 12 and the return flow end 13 of the spiral tube lie close beside one another in the cylinder wall 2, in the region of the cylinder wall 2 adjacent to the end closure 4. In its region adjacent to the end closure 3, the spiral tube 5 is provided with a return bend 14. Between the inflow and return flow ends 12, 13 on the one hand and the return bend 14 on the other hand, the spiral tube extends helically in the cylinder wall 2 as illustrated by the tube axis 15 shown in chain line.

The end closure 4 comprises an outer end ring 16 which is welded to the cylinder wall 2 as well as an outer cover 17 and an inner cover 18. The outer cover 17 is bolted to the end ring 16 by means of a flange 19 and has an outer trunnion 20 for the rotatable mounting of the roll in a bearing indicated diagrammatically at 21. The trunnion 20 is connected to a rotary inlet 22, known per se, for the flowing medium, which comprises a medium inflow 23 and a medium outflow 24. For the connection to the roll, the rotary inlet 22 has a threaded pin 25 to which the trunnion 20 is screwed.

The two coaxial flow passages 10 and 11 extend through the trunnion 20. The flow passage 10 is formed from an inner tube 26 which is located by one end in the rotary inlet 22 and is in flow communication with its medium inflow 23. The other end of the inner tube 26 is located in a central insert portion 27 of the inner cover 18 which engages in a central aperture in the outer cover 17. The flow passage 11 is formed from an annular space 28 which surrounds the inner tube 26 and is formed in the interior of the trunnion 20 and which is continued at one end in a corresponding annular space in the connecting pin 25 of the rotary inlet 22 in which it is in flow communication, via a widened annular space 29, with the medium outflow 24 of the rotary inlet 22. At its other end, the annular space 11 leads, via a widened annular space 30, into an axial passage 31 extending through the inner cover 18.

The end regions of the two flow passages 10 and 11, leading into the inner cover 18 are each connected, for example screwed, via a flexible connecting pipe 32, 33, to the inflow end 12 and the return flow end 13 respectively of the spiral tube 5. The flexible connecting pipe 32 connects a short axial passage 34 in the extension of a central bore 35 in which the inner tube 26 is located, to the inner medium passage 10. The flexible connecting pipe 33, for its part, is connected to the axial through passage 31 in the inner cover 18.

Apart from this, the inner cover 18 comprises a marginal flange 36 by which it is bolted to the inside of the outer ring 17 with the interposition of an annular seal 37. Furthermore, the central insert portion 27 of the inner ring 18 is provided, in the bore 35, with an annular seal 38 which is in sealing engagement with the outer circumference of the inner tube 26 and seals this off from the flow passage 11.

I claim:

1. A method for making a roll used for processing material in the form of a web or strip comprising the steps of forming a metal tube into a spiral, centrifugally casting a metal of distinctly lower melting temperature than that of said spiral tube about said spiral tube and thereby forming a cylindrical hollow body about said spiral tube such that the spiral tube is embedded in the walls of the cylindrical body, shrinking said cylindrical body onto said spiral tube during cooling of the cylindrical body to thereby provide intimate contact between the spiral tube and the cylindrical body and to thereby rigidly embed said spiral tube within the walls of said cylindrical body, and precluding said spiral tube from softening and melting during said centrifugal casting to thereby prevent welding between said spiral tube and said cylindrical body such that the shape and configuration of the spiral tube is retained during the forming of the roll.

2. A method according to claim 1, wherein the melting temperature of the metal of said spiral tube is at least twice the melting temperature of the metal of said cylindrical body.

3. A method according to claim 1, wherein said spiral tube comprises steel or a steel alloy and said cylindrical body comprises aluminum or an aluminum alloy.

4. A method for making a roll used for processing material in the form of a web or strip comprising the steps of forming a metal tube into a spiral, centrifugally casting a metal about said spiral tube and thereby forming a cylindrical hollow body about said spiral tube such that the spiral tube is embedded in the walls of the cylindrical body, precluding softening or melting of said spiral tube and thereby preventing welding between said spiral tube and said casting metal during said centrifugal casting step by selecting the metal for said spiral tube and said cylindrical body such that the melting temperature of said spiral tube is at least twice the melting temperature of the metal of said cylindrical body, maintaining the shape and configuration of said spiral tube during the centrifugal casting step by said preclusion of softening or melting of said spiral tube during the centrifugal casting step, shrinking said cylindrical body onto said spiral tube during cooling of the cylindrical body to thereby provide intimate contact between the spiral tube and the cylindrical body and to thereby rigidly embed said spiral tube within the walls of said cylindrical body with a shrink fit and non-welded securement.

* * * * *